US009186891B2

(12) United States Patent
Norigoe

(10) Patent No.: US 9,186,891 B2
(45) Date of Patent: Nov. 17, 2015

(54) INKJET HEAD, DRIVING DEVICE OF INKJET HEAD AND DRIVING METHOD THEREOF

(71) Applicants: KABUSHIKI KAISHA TOSHIBA, Tokyo (JP); TOSHIBA TEC KABUSHIKI KAISHA, Tokyo (JP)

(72) Inventor: Takashi Norigoe, Shimizu Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/477,706

(22) Filed: Sep. 4, 2014

(65) Prior Publication Data

US 2015/0070423 A1 Mar. 12, 2015

(30) Foreign Application Priority Data

Sep. 6, 2013 (JP) ..... 2013-185632

(51) Int. Cl.
*B41J 29/38* (2006.01)
*B41J 2/045* (2006.01)

(52) U.S. Cl.
CPC ..... *B41J 2/04588* (2013.01); *B41J 2/04573* (2013.01); *B41J 2/04581* (2013.01); *B41J 2/04598* (2013.01)

(58) Field of Classification Search
CPC ..... B41J 2/04583; B41J 2/04596
See application file for complete search history.

(56) References Cited

U.S. PATENT DOCUMENTS 6,109,716 A * 8/2000 Takahashi ..... 347/11
2013/0063508 A1* 3/2013 Norigoe ..... 347/11

FOREIGN PATENT DOCUMENTS

JP 2008-023865 A 2/2008
JP 2012-101499 5/2012
JP 2013-031968 A 2/2013

OTHER PUBLICATIONS

Japanese Office Action with English translation, Patent Application No. JP 2013-185632, Jun. 23, 2015, 9 pages.

* cited by examiner

*Primary Examiner* — Shelby Fidler
*Assistant Examiner* — Tracey McMillion
(74) *Attorney, Agent, or Firm* — Patterson & Sheridan, LLP

(57) ABSTRACT

A driving device of an inkjet head including a pressure chamber for accommodating ink, a nozzle that communicates with the pressure chamber to eject the ink in the pressure chamber, and an actuator for expanding or contracting a volume of the pressure chamber, is provided with a drive circuit that applies a driving signal to the inkjet head. The driving signal includes: a first contracting pulse, a first expanding pulse following the first contracting pulse, a second contracting pulse following the first expanding pulse, a second expanding pulse following the second contracting pulse, and a third contracting pulse following the second expanding pulse.

20 Claims, 5 Drawing Sheets

FIG. 6
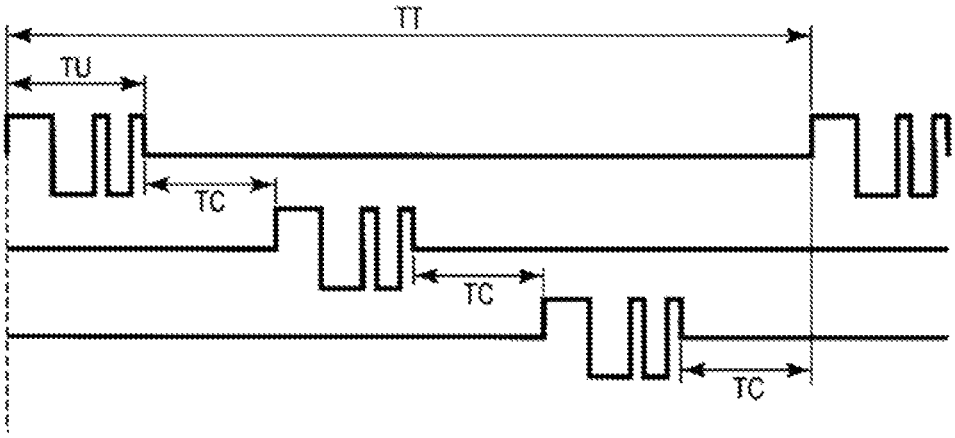
FIG. 7
| | TB/Ta | | | |
|---|---|---|---|---|
| TD2/Ta | 0.8 | 0.9 | 1.0 | 1.1 |
| 0.29 | × | × | × | × |
| 0.36 | × | × | × | × |
| 0.43 | × | ○ | ○ | × |
| 0.50 | × | ○ | × | × |
| 0.57 | × | ○ | × | × |
| 0.64 | × | × | × | × |
FIG. 8
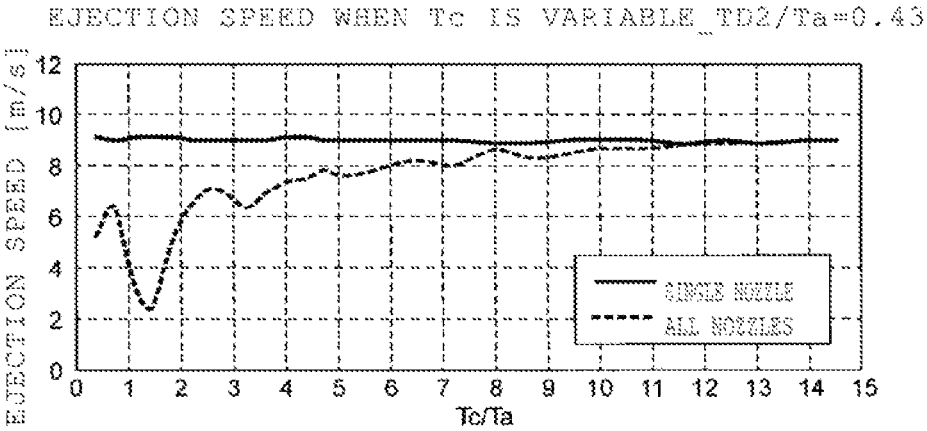

INKJET HEAD, DRIVING DEVICE OF INKJET HEAD AND DRIVING METHOD THEREOF

CROSS-REFERENCE TO RELATED APPLICATION

This application is based upon and claims the benefit of priority from Japanese Patent Application No. 2013-185632, filed Sep. 6, 2013, the entire contents of which are incorporated herein by reference.

FIELD

Embodiments described herein relate generally to an inkjet head, a driving device of an inkjet head and a driving method thereof.

BACKGROUND

A printer may employ various designs. A printer includes, for example, an inkjet head and a driving device for driving the inkjet head. When a driving voltage is applied from a driving device, an inkjet head elects ink droplets to a printing medium. Based on image data for printing, the driving device applies a driving voltage to the inkjet head; thereby a design corresponding to the image data, such as letters and images, may be printed on the printing medium.

In the above inkjet head of the related art, however, when ink droplets having high viscosity are ejected, a higher driving voltage is required. Accordingly, power consumption gets larger. When the ink droplet is ejected from a nozzle hole of the inkjet head, a liquid column (tailing) gets longer and does not cut well. As a result, there is a possibility that the printing quality may be deteriorated.

BRIEF DESCRIPTION OF THE DRAWINGS

FIG. 6 illustrates another aspect of the driving signal of the driving device.

FIG. 7 illustrates results of stability evaluation of ink droplets from the inkjet head.

FIGS. 8-11 illustrate different graphs of ejection speed from the inkjet head.

DETAILED DESCRIPTION

Embodiments provide a driving device of an inkjet head capable of ejecting ink droplets more stably and a driving method thereof.

According to one embodiment, a driving device of an inkjet head including a pressure chamber for accommodating ink, a nozzle that communicates with the pressure chamber to eject the ink in the pressure chamber, and an actuator for expanding or contracting a volume of the pressure chamber, is provided with a drive circuit that applies a driving signal to the inkjet head, the driving signal including: a first contracting pulse that causes the actuator to contract the volume of the pressure chamber and a meniscus of ink to move in an ejecting direction in the nozzle, a first expanding pulse following the first contracting pulse that causes the actuator to expand the volume of the pressure chamber and the meniscus of ink to move in a direction opposite the ejecting direction, a second contracting pulse following the first expanding pulse that causes the actuator to contract the volume of the pressure chamber and the meniscus of ink to move in the electing direction and form an ink column extending from the nozzle, a second expanding pulse following the second contracting pulse that causes the actuator to expand the volume of the pressure chamber and the meniscus of ink to move in the direction opposite the ejecting direction and cut off the ink column to form an ink droplet, and a third contracting pulse following the second expanding pulse that causes the actuator to contract the volume of the pressure chamber and substantially cancel a pressure vibration in the pressure chamber.

Hereinafter, the embodiment will be described with reference to the drawings.

Figure 1:
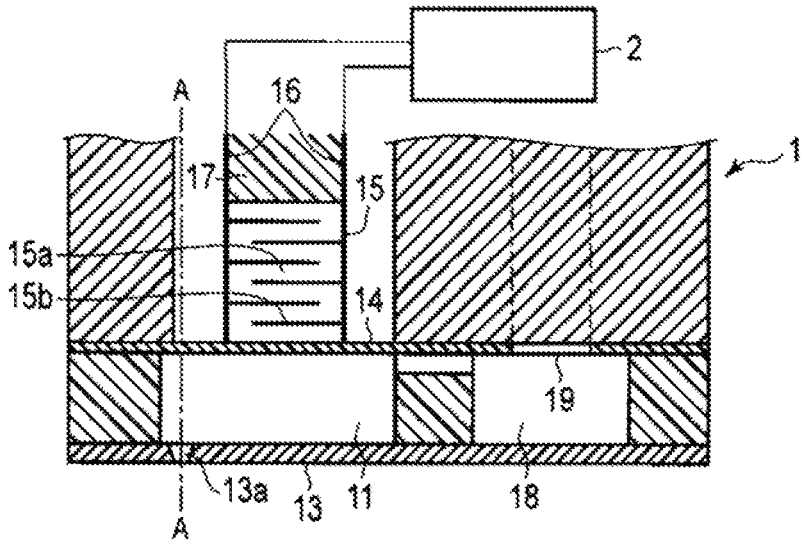
FIG. 1 is a cross-sectional view illustrating an inkjet head, according to one embodiment.
Figure 2:
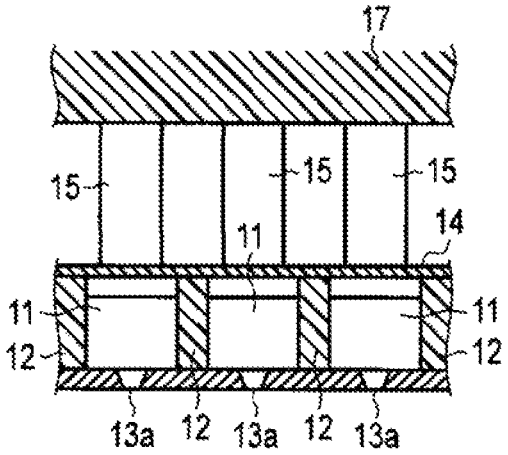
FIG. 2 is a cross-sectional view illustrating the inkjet head according, taken along the line A-A of FIG. 1.

FIGS. 1 and 2 illustrate an example of an inkjet head 1 according to one embodiment. FIG. 1 is a cross-sectional view illustrating the structure of the inkjet head 1. FIG. 2 is a cross-sectional view of the inkjet head 1 taken along the line AA of FIG. 1.

The inkjet head 1 includes a pressure chamber 11, a partition wall 12, a nozzle plate 13, a vibration plate 14, a piezoelectric member 15, an electrode 16, a supporting member 17, a common pressure chamber 18, and an ink supply opening 19. The inkjet head 1 is connected to a driving device 2. The inkjet head 1 works according to a signal supplied from the driving device 2.

The pressure chamber 11 accommodates ink. The inkjet head 1 includes a plurality of pressure chambers 11 divided by the partition wall 12. The nozzle plate 13 is attached to the bottom surfaces of the respective pressure chambers 11.

The nozzle plate 13 includes a plurality of nozzles 13*a*. The nozzle 13*a* is a nozzle hole for ejecting ink droplets. The nozzle 13*a* is formed as an orifice penetrating the nozzle plate 13. The nozzles 13*a* are respectively formed in the nozzle plate 13 so as to correspond to bottom surfaces of the pressure chambers 11.

The vibration plate 14 is attached to the top surfaces of the pressure chambers 11. Further, the piezoelectric members 15 are attached to the vibration plate 1A opposite to the pressure chambers 11. Further, the supporting member 17 is fixed to the ends of the piezoelectric members 15 on the side opposite to the vibration plate 14. The piezoelectric members 15 are provided in alignment with the pressure chambers 11. The vibration plate 14 and the piezoelectric member 15 work as an actuator.

The piezoelectric member 15 is formed with a stacked structure having a plurality of piezoelectric layers 15*a* and plurality of electrode layers 15*b* alternatively stacked. The piezoelectric layer 15*a* includes, for example, a piezoelectric element which varies in volume when a voltage is applied there. The electrodes 16 are respectively formed on one lateral surface of the stacked structure and the opposite lateral surface. In other words, the electrodes 16 are formed together with the stacked structure. The electrodes 16 are electrically connected to the electrode layers 15*b*. The piezoelectric member 15 is formed so that the electrode layer 15*b* connected to one electrode 16 and the electrode layer 15*b* connected to the other electrode 16 are alternatively stacked. The electrodes 16 are electrically connected to output terminals of the driving device 2.

The driving device 2 applies a driving signal to the electrodes 16. In this case, a potential difference occurs between the electrodes 16. Specifically, a potential difference occurs between opposing electrode layers 15*b* connected to the electrodes 16. Thus, a voltage is applied to the piezoelectric layer 15*a* between two electrode layers 15*b*. As the result, the volume of the piezoelectric layer 15*a* varies. Accordingly, by applying a driving signal to the electrodes 16, the driving device 2 may drive the actuator.

As noted, the supporting member 17 is fixed to the piezoelectric members 15 on the side opposite to the vibration plate 14, and therefore the piezoelectric members 15 may operate the vibration plate 14 according to a driving signal supplied from the driving device 2. For example, when a pulse signal is applied to the electrodes 16 as a driving signal, the piezoelectric member 15 vibrates. As the result, the piezoelectric member 15 vibrates the vibration plate 14. By operating the vibration plate 14, the inkjet head 1 may vary the volume of the pressure chamber 11.

As illustrated in FIG. 1, the common pressure chamber 18 communicates with the respective pressure chambers 11. The common pressure chamber 18 includes the ink supply opening 19. The common pressure chamber 18 may receive ink from an ink supplying unit (such as, for example, an ink tank) through the ink supply opening 19. In other words, the common pressure chamber 18, the plural pressure chambers 11, and the plural nozzles 13*a* are filled with the ink supplied from the ink supplying unit. By filling the pressure chambers 11 and the nozzles 13*a* with ink, a meniscus of ink is formed within each of the nozzles 13*a*. According to this, the ink is maintained within the nozzle 13*a*.

When the volume of the pressure chamber 11 varies with the ink filled in the pressure chamber 11 and the nozzle 13*a*, the ink is sucked from the common pressure chamber 18 to the pressure chamber 11 and the ink is ejected from the nozzle 13*a* as an ink droplet.

In other words, when a driving signal supplied from the driving device 2 is applied to the piezoelectric member 15, the piezoelectric member 13 expands or contracts. According to this, the vibration plate 14 fixed to the piezoelectric member 15 deforms and the volume of the pressure chamber 11 varies. Thus, a pressure wave occurs within the pressure chamber 11 and the ink is ejected from the nozzle 13*a*.

Figure 3:
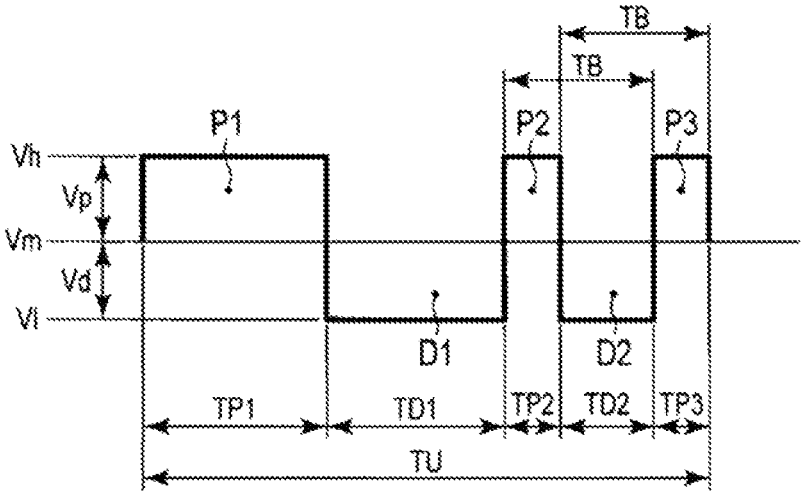
FIG. 3 illustrates a driving signal of a driving device, according to the embodiment.
Figure 4:
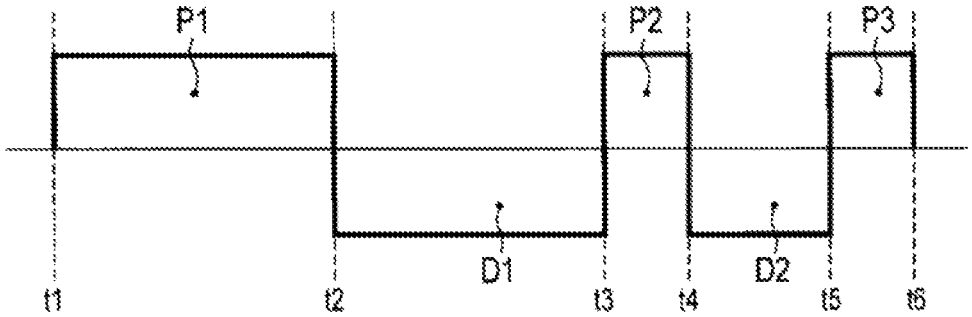
FIG. 4 further illustrates the driving signal of the driving device.

FIGS. 3 and 4 illustrate an example driving signal of the driving device 2. The driving device 2 creates a driving signal based on printing data. The driving device 2 includes a receiving portion for receiving the printing image and a drive circuit for converting the received printing image into a driving signal and then supplying the driving signal.

The driving device 2 provides a driving signal as illustrated in FIG. 3 to the inkjet head 1 in order to eject the ink droplets for one dot from the nozzle 13*a* of the inkjet head 1.

The driving signal has a plurality of expanding pulses D1 and D2 for expanding the pressure chamber 11 and a plurality of contracting pulses P1, P2, and P3 for contracting the pressure chamber 11.

The driving device 2 applies a reference potential Vm to the piezoelectric member 15 in the normal state. The driving device 2 applies a pulse at a potential Vl lower than, the reference potential Vm, as the expanding pulse. The potential Vl is lower than the reference potential Vm by a potential Vd.

Further, the driving device 2 applies a pulse at a potential Vh higher than the reference potential Vm, as the contracting pulse. The potential Vh is higher than the reference potential Vm by a potential Vp.

Figure 5A:
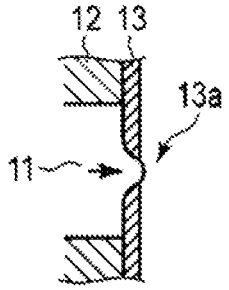
FIGS. 5A to 5F are views illustrating the inkjet head according to the embodiment.

The driving device 2 applies the first contracting pulse P1 having the potential Vh to the inkjet head 1 at a timing t1. At this time, as illustrated in FIG. 5A, the pressure within the pressure chamber 11 becomes a positive pressure, the meniscus in the distal end of the nozzle 13*a* moves forward in an ejecting direction. The driving device 2 applies the first contracting pulse P1 to the inkjet head 1 during a period TP1. In other words, the pulse width of the first contracting pulse P1 is TP1.

Figure 5B:
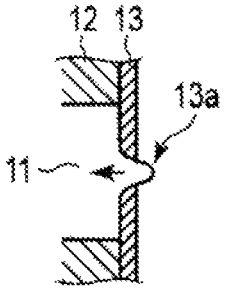

The driving device 2 applies a first expanding pulse D1 having the potential Vl to the inkjet head 1 at a timing t2. At this time, as illustrated in FIG. 5B, the pressure within the pressure chamber 11 becomes a negative pressure, the meniscus in the distal end of the nozzle 13*a* moves backward into the pressure chamber 11. The driving device 2 applies the first expanding pulse D1 to the inkjet head 1 during a period TD1. In other words, the pulse width of the first expanding pulse D1 is TD1.

The pulse width TP1 of the first contracting pulse P1 is set at a half of an inherent vibration cycle of the ink inside the pressure chamber 11, which is determined by the shape of the pressure chamber 11, the material of the pressure chamber 11, and the solid state properties of the ink, specifically, a pressure propagation time Ta. Here, the pressure propagation time Ta is an inherent value. Thus, the pressure within the pressure chamber 11 is inverted to a negative pressure at the timing t2 after elapse of TP1 from the timing t1. When the voltage of the driving signal is returned from Vh to Vm at the timing t2, the piezoelectric member 15 and the vibration plate 14 return to the normal state. Accordingly, the volume of the pressure chamber 11 is returned to the normal state.

When the voltage of the driving signal is decreased from Vm to Vl at the timing t2, the piezoelectric member 15 contracts and the volume of the pressure chamber 11 expands more than the normal state. According to this, the pressure within the pressure chamber 11 becomes a negative pressure at the timing t2. In other words, by inverting the pressure within the pressure chamber 11 into a negative pressure according to the inherent vibration cycle and then applying the expanding pulse TD1, the driving device 2 may increase the pressure change within the pressure chamber 11 much more than in the case of applying the expanding pulse TD1 from the normal state.

Figure 5C:
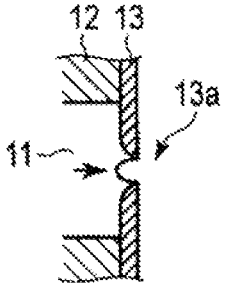

The driving device 2 applies a second contracting pulse P2 having the potential Vh to the inkjet head 1 at a timing t3. At this time, as illustrated in FIG. 5C, the pressure within the pressure chamber 11 becomes a positive pressure and the meniscus in the distal end of the nozzle 13*a* is pushed forward in the ejecting direction. The driving device 2 applies the second contracting pulse P2 to the inkjet head 1 during a period TP2. In other words, the pulse width of the second contracting pulse P2 is TP2.

Here, the pulse width TD1 of the first expanding pulse D1 is also set at a half of the inherent vibration cycle of the ink within the pressure chamber 11, which is determined by the shape of the pressure chamber 11, the material of the pressure chamber 11, and the solid state properties of the ink, specifically, the pressure propagation time Ta. Thus, the pressure within the pressure chamber 11 is inverted into a positive pressure at the timing t3 after elapse of TD1 from the timing t2. When the voltage of the driving signal is returned from Vl to Vm at the timing t3, the piezoelectric member 15 and the vibration plate 14 return to the normal state. Accordingly, the volume of the pressure chamber 11 is returned to the normal state.

When the voltage of the driving signal is increased from Vm to Vh at the timing t3, the piezoelectric member 15 expands and the volume of the pressure chamber 11 is again contracted from the normal state. Accordingly, the pressure within the pressure chamber 11 is changed into a positive pressure at the timing t3. By inverting the pressure within the pressure chamber 11 into a positive pressure according to the inherent vibration cycle and then applying the contracting pulse P2, the driving device 2 may increase the pressure change within the pressure chamber 11 much more than in the case of applying the contracting pulse P2 from the normal state.

Figure 5D:
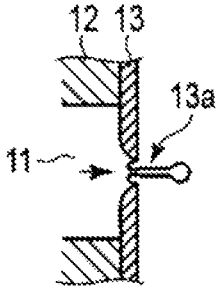

The meniscus gets pushed forward in the ejecting direction during the period TP2 when the second, contracting pulse P2 is applied, and as illustrated in FIG. 5D, a liquid column is formed.

Figure 5E:
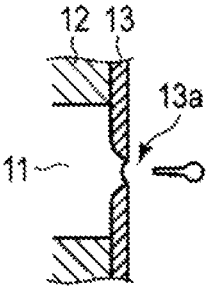

The driving device 2 applies a second expanding pulse D2 having the potential Vl to the inkjet head 1 at a timing t4 before cut-off of the liquid column. The driving device 2 applies the second expanding pulse D2 to the inkjet head 1 during a period TD2. In other words, the pulse width of the second expanding pulse D2 is TD2. In this case, the driving device 2 may change the pressure within the pressure chamber 11 into a negative pressure. As the result, the driving device 2 may cause the meniscus in the distal end of the nozzle 13*a* to retreat into the pressure chamber 11. As illustrated in FIG. 5E, the liquid column may be cut off.

By making the inside of the pressure chamber 11 into a negative pressure after the liquid column is formed, the driving device 2 may cut the liquid column at a timing earlier than in the case of not applying the second expanding pulse D2. As the result, the driving device 2 may make the volume of an ink droplet smaller.

After keeping the second expanding pulse D2 during the period TD2, the driving device 2 applies a third contracting pulse P3 having the potential Vh to the inkjet head 1 at a timing t5. The driving device 2 applies the third contracting pulse P3 to the inkjet head 1 during a period TP3. In other words, the pulse width of the third contracting pulse P3 is TP3.

The third contracting pulse P3 is a pulse for cancelling a pressure vibration within the pressure chamber 11. At the timing t5 after elapse of a time TB from the timing t3, the pressure vibration at the rising of the second contracting pulse P2 remains within the pressure chamber 11. The driving device 2 may cancel the pressure vibration at the rising of the second contracting pulse P2 by applying the third contracting pulse P3 at the timing t5.

Figure 5F:
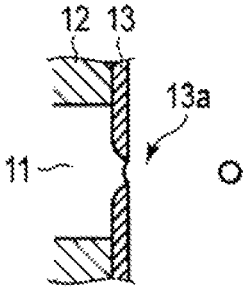

At a timing t6 (after elapse of the time TB from, the timing t4), the pressure vibration from the end of the second expanding pulse D2 remains within the pressure chamber 11. By ending the third contracting pulse P3 at the timing to, the driving device 2 may cancel the pressure vibration at the end of the second expanding pulse D2. As the result, as illustrated in FIG. 5F, the driving device 2 may cancel the pressure vibration within the pressure chamber 11 after ejection of the droplet and make the inside of the pressure chamber 11 stable. The driving device 2 may eject the ink droplets for one dot from the inkjet head 1, through the above processing during a time TU=TP1+TD1+TP2+TD2+TP3.

As mentioned above, the driving device 2 switches the pressure within the pressure chamber 11 of the inkjet head 1 from a positive pressure to a negative pressure and then switches the above to a positive pressure again, which makes it possible to eject the ink droplets having high viscosity through the nozzle 13*a* with a lower driving voltage. The driving device 2 switches the pressure within the pressure chamber 11 of the inkjet head 1 to a negative pressure again after a liquid column of ink is formed, which makes it possible to shorten the trailing of the liquid column and decrease the volume of the droplet. As the result, there may be provided a driving device of an inkjet head capable of ejecting ink droplets more stably and a driving method thereof.

The above time TB=TP2+TD2=TD2+TP3 is set at a value close to the pressure propagation time Ta so that the pressure vibration remaining within the pressure chamber 11 is cancelled by the third contracting pulse P3. In other words, the time TB is set so that the pressure vibration created by the rising of the second contracting pulse P2 and the pressure vibration created by the rising of the third contracting pulse P3 may be opposite in phase at the timing t5. Further, the time TB is set so that the pressure vibration created by the falling of the second expanding pulse D2 and the pressure vibration created by the failing of the third contracting pulse P3 may be opposite in phase at the timing t6. In short, TP2 and TP3 are set as TP2=TP3.

Further, when ink droplets are simultaneously ejected front the plural nozzles 13*a* included, in the nozzle plate 13, a rise in temperature in the driving device 2 and the inkjet head 1 becomes a problem. As illustrated in FIG. 6, the driving device 2 may be designed to apply a driving signal with a staggered timing for the nozzles 13*a*.

For example, in an example of FIG. 6, the driving device 2 divides the plurality of nozzles 13*a* into three groups and applies a driving signal to the inkjet head 1 with a staggered timing for every divided group.

When the time for ejecting the ink droplets for one dot from the inkjet head 1 (drop cycle) is defined as TU and an interval of the driving signals for each groups (delay time) is defined as Tc, a driving cycle TT per one nozzle is TT=3×(TU+Tc). A driving frequency F is an inverse number of TT, F=1/TT.

FIG. 7 illustrates stability evaluation of ink droplets. FIG. 7 is the stability evaluation results of ink droplets when varying the pulse width TP2 of the second contracting pulse P2, the pulse width TD2 of the second expanding pulse D2, and the pulse width TP3 of the third contracting pulse P3.

Further, FIGS. 8, 9, 10, and 11 illustrate the measurement results of ejection speed of droplet. FIG. 8 illustrates a relation between the delay time and the ejection speed of ink droplet when TB/Ta=1 and TD2/Ta=0.43. FIG. 3 represents the delay time as Tc/Ta, a ratio of the delay time to the pressure propagation time Ta.

The inkjet head 1 of this example is formed so that the voltage of a driving signal may be Vp=Vd and so that the ejection speed of ink droplet may be 9 m/s when the delay time is long enough.

A solid line in FIG. 8 illustrates the ejection speed of an ink droplet when a single nozzle 13*a* is driven. Further, a dotted line in FIG. 8 illustrates the ejection speed of ink droplets when ail the nozzles within the nozzle plate 13 are driven.

As illustrated in FIG. 8, when a single nozzle 13*a* is driven, a fluctuation in the ejection speed of ink droplet is small even when the value of Tc/Ta varies. On the other hand, when all the nozzles within the nozzle plate 13 are driven, a fluctuation in the ejection speed of ink droplet is large according to the value of Tc/Ta. In particular, when the value of Tc/Ta is small in the driving of all the nozzles, the fluctuation in the ejection speed of ink droplet is larger.

This is because of the influence by the remaining vibration within the pressure chamber 11 of the adjacent nozzle 13*a* when the delay time Tc is not sufficiently long. Due to this crosstalk, the ejection speed of ink droplet may be sometimes unstable. When the delay time Tc is long enough, however, a driving cycle TT per one nozzle becomes longer. As the result, printing speed is deteriorated.

As illustrated in FIG. 8, there are a plurality of peaks in the fluctuation of the ejection speed of ink droplets according to a change in the Tc/Ta. By supplying a driving signal to the inkjet head 1 at the Tc/Ta corresponding to these peaks, the driving device 2 may stably eject ink droplets with a short Tc.

In FIG. 7, in the case of varying the Tc/Ta, when there occurs such a phenomenon that the ejection speed of ink droplet gets unstable, the ejecting direction of ink droplet is undesirable, or ink droplet is not ejected, the stability is determined as "x". Further, in FIG. 7, in the case of varying the Tc/Ta, when there occurs none of these phenomena, the stability is determined as "o".

According to FIG. 7, the range of TD2/Ta in which the ejection of ink droplet gets stable is wider in TB/Ta=0.9 than in TB/Ta=1. In other words, when TB/Ta=0.9 and TD2/Ta=0.43, 0.50, or 0.57, the ejection of ink droplets is stable. According to this, by setting at TB/Ta=0.9, the ejection of ink droplet may be more stable even in the case of Ta scattering in every nozzle 13*a*.

Figure 9:
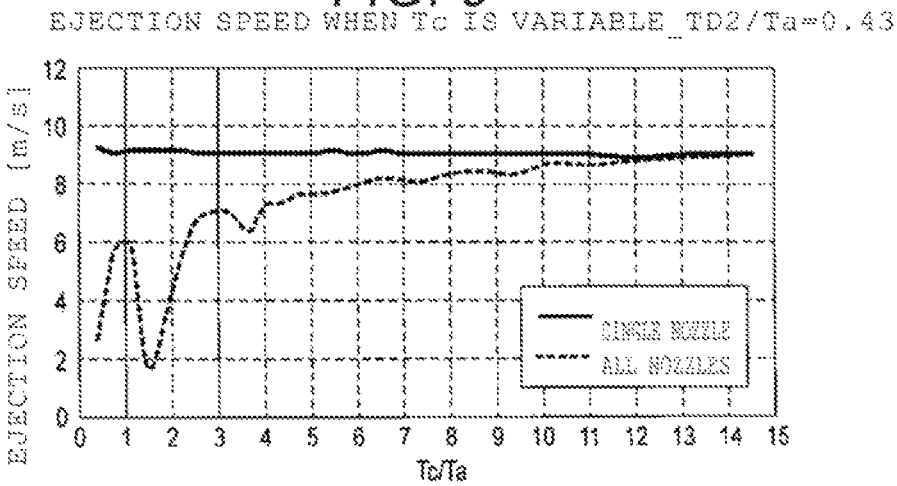
Figure 10:
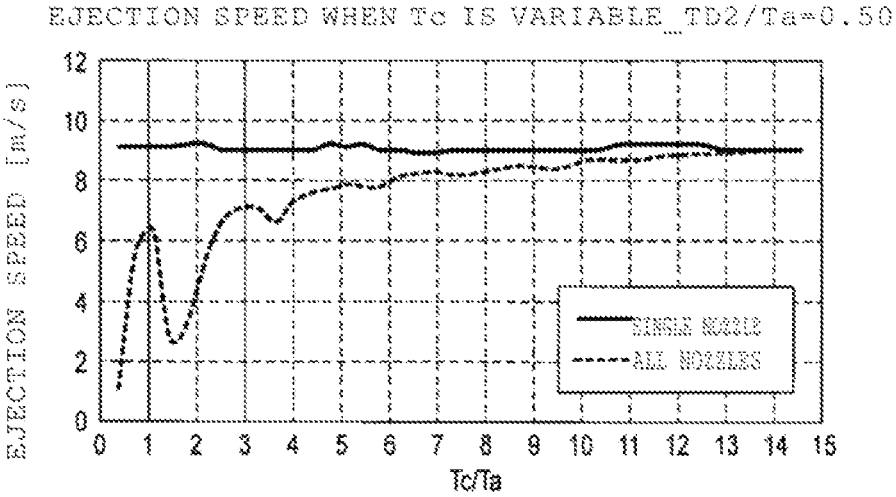
Figure 11:
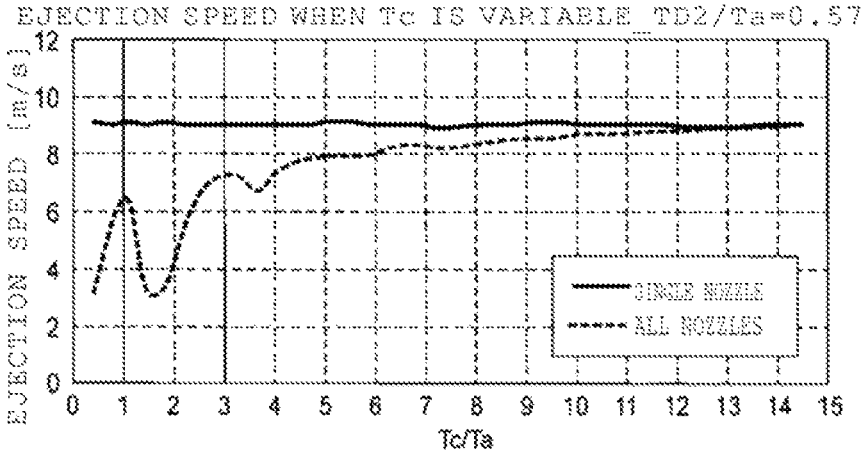

FIGS. 9, 10, and 11 illustrate the measurement results of the ejection speed of ink droplet in the case of TB/Ta=0.9. FIG. 9 illustrates a relation between the delay time and the ejection speed of ink droplet, in the case of TD2/Ta=0.43. FIG. 10 illustrates a relation between the delay time and the ejection speed of ink droplet in the case of TD2/Ta=0.50. FIG. 11 illustrates a relation between the delay time and the ejection speed of ink droplet in the case of TD2/Ta=0.57.

According to the examples in FIGS. 9, 10, and 11, when Tc/Ta=1 or 3 and its vicinity, a difference between the ejection speed for a single nozzle driving and the ejection speed all the nozzles driving is comparatively small in either case. In other words, when Tc/Ta=1 or 3 and its vicinity, a peak is found in the fluctuation in the ejection speed of ink droplet. Thus, by supplying a driving signal to the inkjet head 1 with Tc/Ta set at 1 or 3, it is possible to eject ink droplets stably with a short Tc.

By driving the inkjet head as mentioned above, the driving device 2 may suppress the influence of crosstalk without decreasing the driving frequency. As the result, the driving device 2 may eject a smaller ink droplet stably and perform the printing with a good quality.

The above embodiment has been described with the length of TD1 and TP1 set at the pressure propagation time Ta. However, the length of TD1 and TP1 may be a half of the pressure propagation time Ta, or around one and a half of the pressure propagation time Ta, the pressure within the pressure chamber 11 may be amplified as mentioned above.

In the above described embodiment, the pressure propagation time Ta is Ta=2.8 μs. In this example, the pulse width of each pulse in the driving waveform of FIG. 3 is TP1=Ta=2.8 μs, TD1=Ta=2.8 μs, TD2=0.5×Ta=1.4 μs, and TP2=TP3=TB−TD2=0.9×Ta−TD2=1.1 μs. Each time in FIG. 6 is TU=TP1+TD1+TP2+TD2+TP3=9.2 μs, TC=3×Ta=8.4 μs, TT=3×(TU+TC)=52.8 μs. Further, the driving frequency F is F=1/TT=18.9 kHz.

When the pressure propagation time Ta is Ta=2.8 μs in the inkjet head 1, the driving device 2 may suppress the influence of crosstalk without decreasing the driving frequency by applying a driving signal set at the above values to the inkjet head.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A driving device for an inkjet head including a pressure chamber for accommodating ink, a nozzle that communicates with the pressure chamber to eject the ink in the pressure chamber, and an actuator for expanding or contracting a volume of the pressure chamber, the driving device comprising:

a drive circuit configured to apply a driving signal to the inkjet head, the driving signal including:

a first contracting pulse that causes the actuator to contract the volume of the pressure chamber and a meniscus of ink to move in an ejecting direction in the nozzle, a first expanding pulse following the first contracting pulse that causes the actuator to expand the volume of the pressure chamber and the meniscus of ink to move in a direction opposite the ejecting direction, a second contracting pulse following the first expanding pulse that causes the actuator to contract the volume of the pressure chamber and the meniscus of ink to move in the ejecting direction and form an ink column extending from the nozzle, a second expanding pulse following the second contracting pulse that causes the actuator to expand the volume of the pressure chamber and the meniscus of ink to move in the direction opposite the ejecting direction and cut off the ink column to form an ink droplet, and a third contracting pulse following the second expanding pulse that causes the actuator to contract the volume of the pressure chamber and substantially cancel a pressure vibration in the pressure chamber.

2. The device according to claim 1, wherein a pulse width of the first contracting pulse is substantially equal to one half of a pressure wave propagation time across the pressure chamber.

3. The device according to claim 1, wherein a sum of a pulse width of the first contracting pulse and a pulse width of the first expanding pulse is substantially equal to a pressure wave propagation time across the pressure chamber.

4. The device according to claim 3, wherein a sum of a pulse width of the second contracting pulse and a pulse width of the second expanding pulse is substantially equal to 0.9 of the pressure wave propagation time, a sum of a pulse width of the third contracting pulse and a pulse width of the second expanding pulse is 0.9 of the pressure wave propagation time, and the pulse width of the second contracting pulse and the pulse width of the third contracting pulse are each between approximately 0.43 to 0.57 of the pressure wave propagation time.

5. The device according to claim 1, wherein the inkjet head includes a plurality of pressure chambers, nozzles and actuators, and the drive circuit applies the driving signal with a staggered timing to each actuator.

6. The device according to claim 5, wherein the drive circuit applies the driving signal with a staggered timing to each of three groups of actuators.

7. The device according to claim 6, wherein:

a time between an end of the third contracting pulse for the driving signal to a first group and a beginning of the first contracting pulse for the driving signal to a second group is a delay time, and a ratio of the delay time to a pressure wave propagation time across the pressure chamber is approximately 1.

8. The device according to claim 6, wherein:

a time between an end of the third contracting pulse for the driving signal to a first group and a beginning of the first contracting pulse for the driving signal to a second group is a delay time, and a ratio of the delay time to a pressure wave propagation time across the pressure chamber is approximately 3.

9. An inject head comprising:

a pressure chamber for accommodating ink;

a nozzle that communicates with the pressure chamber to eject the ink in the pressure chamber;

an actuator for expanding or contracting a volume of the pressure chamber; and a drive circuit configured to apply a driving signal to the actuator, the driving signal including:

a first contracting pulse that causes the actuator to contract the volume of the pressure chamber and a meniscus of ink to move in an ejecting direction in the nozzle, a first expanding pulse following the first contracting pulse that causes the actuator to expand the volume of the pressure chamber and the meniscus of ink to move in a direction opposite the ejecting direction, a second contracting pulse following the first expanding pulse that causes the actuator to contract the volume of the pressure chamber and the meniscus of ink to move in the ejecting direction and form an ink column extending from the nozzle, a second expanding pulse following the second contracting pulse that causes the actuator to expand the volume of the pressure chamber and the meniscus of ink to move in the direction opposite the ejecting direction and cut off the ink column to form an ink droplet, and a third contracting pulse following the second expanding pulse that causes the actuator to contract the volume of the pressure chamber and substantially cancel a pressure vibration in the pressure chamber.

10. The inkjet head according to claim 9, wherein a pulse width of the first contracting pulse is substantially equal to one half of a pressure wave propagation time across the pressure chamber.

11. The inkjet head according to claim 9, wherein a sum of a pulse width of the first contracting pulse and a pulse width of the first expanding pulse is substantially equal to a pressure wave propagation time across the pressure chamber.

12. The inkjet head according to claim 11, wherein a sum of a pulse width of the second contracting pulse and a pulse width of the second expanding pulse is substantially equal to 0.9 of the pressure wave propagation time, a sum of a pulse width of the third contracting pulse and a pulse width of the second expanding pulse is 0.9 of the pressure wave propagation time, and the pulse width of the second contracting pulse and the pulse width of the third contracting pulse are each between approximately 0.43 to 0.57 of the pressure wave propagation time.

13. The inkjet head according to claim 9, wherein the inkjet head includes a plurality of pressure chambers, nozzles and actuators, and the drive circuit applies the driving signal with a staggered timing to each actuator.

14. The inkjet head according to claim 13, wherein the drive circuit applies the driving signal with a staggered timing to each of three groups of actuators.

15. The inkjet head according to claim 14, wherein:

a time between an end of the third contracting pulse for the driving signal to a first group and a beginning of the first contracting pulse for the driving signal to a second group is a delay time, and a ratio of the delay time to a pressure wave propagation time across the pressure chamber is approximately 1.

16. A method of driving an inkjet head including a pressure chamber for accommodating ink, a nozzle that communicates with the pressure chamber to eject the ink in the pressure chamber, and an actuator for expanding or contracting a volume of the pressure chamber, the method comprising the steps of:

applying to the actuator a first contracting pulse that causes the actuator to contract the volume of the pressure chamber and a meniscus of ink to move in an ejecting direction in the nozzle;

applying to the actuator a first expanding pulse following the first contracting pulse that causes the actuator to expand the volume of the pressure chamber and the meniscus of ink to move in a direction opposite the ejecting direction;

applying to the actuator a second contracting pulse following the first expanding pulse that causes the actuator to contract the volume of the pressure chamber and the meniscus of ink to move in the ejecting direction and form an ink column extending from the nozzle;

applying to the actuator a second expanding pulse following the second contracting pulse that causes the actuator to expand the volume of the pressure chamber and the meniscus of ink to move in the direction opposite the ejecting direction and cut off the ink column to form an ink droplet; and applying to the actuator a third contracting pulse following the second expanding pulse that causes the actuator to contract the volume of the pressure chamber and substantially cancel a pressure vibration in the pressure chamber.

17. The method according to claim 16, wherein a sum of a pulse width of the first contracting pulse and a pulse width of the first expanding pulse is substantially equal to a pressure wave propagation time across the pressure chamber.

18. The method according to claim 17, wherein a sum of a pulse width of the second contracting pulse and a pulse width of the second expanding pulse is substantially equal to 0.9 of the pressure wave propagation time, a sum of a pulse width of the third contracting pulse and a pulse width of the second expanding pulse is 0.9 of the pressure wave propagation time, and the pulse width of the second contracting pulse and the pulse width of the third contracting pulse are each between approximately 0.43 to 0.57 of the pressure wave propagation time.

19. The method according to claim 16, wherein the driving signal is applied with a staggered timing to each actuator.

20. The method according to claim 19, wherein:

a time between an end of the third contracting pulse for the driving signal to a first actuator and a beginning of the first contracting pulse for the driving signal to a second actuator is a delay time, and a ratio of the delay time to a pressure wave propagation time across the pressure chamber is approximately 3.

* * * * *